United States Patent [19]

Fischer et al.

[11] Patent Number: 4,490,603

[45] Date of Patent: Dec. 25, 1984

[54] ELECTRIC HOTPLATE WITH A MOUNTING RING AROUND IT

[75] Inventors: Karl Fischer, Am Gänsberg 23, 7519 Oberderdingen, Fed. Rep. of Germany; Felix Schreder, Oberderdingen, Fed. Rep. of Germany

[73] Assignee: Karl Fischer, Fed. Rep. of Germany

[21] Appl. No.: 404,691

[22] Filed: Aug. 3, 1982

[30] Foreign Application Priority Data

Aug. 8, 1981 [DE] Fed. Rep. of Germany ..... 3131463

[51] Int. Cl.[3] ..... H05B 3/68

[52] U.S. Cl. ..... 219/463; 219/459; 219/464; 219/467; 126/211

[58] Field of Search ..... 219/449, 453, 457, 459, 219/460, 461, 462, 463, 464, 467; 126/39 H, 211

[56] References Cited

U.S. PATENT DOCUMENTS

| | | | |
|---|---|---|---|
| 2,664,492 | 12/1953 | Fischer | 219/463 X |
| 3,561,020 | 2/1971 | Fritzsche | 126/211 X |
| 3,569,672 | 3/1971 | Hurko | 219/464 |
| 3,838,249 | 9/1974 | Detterbeck | 219/460 |
| 3,944,786 | 3/1976 | Detterbeck | 219/453 |
| 4,153,833 | 5/1979 | Fischer et al. | 219/449 |
| 4,243,016 | 1/1981 | Kristen et al. | 126/211 |
| 4,363,956 | 12/1982 | Scheidler et al. | 219/464 |

FOREIGN PATENT DOCUMENTS

| | | | |
|---|---|---|---|
| 1089147 | 9/1960 | Fed. Rep. of Germany | 219/464 |
| 2819118 | 10/1979 | Fed. Rep. of Germany | 219/464 |
| 97774 | 1/1961 | Norway | 219/463 |

*Primary Examiner*—Volodymyr Y. Mayewsky
*Attorney, Agent, or Firm*—Steele, Gould & Fried

[57] ABSTRACT

A hotplate is fitted by means of a relatively wide and shallow mounting ring, whose outer edge rests on a mounting plate made from glass, ceramic or other materials. At its edge, the mounting ring is adhered to mounting plate using a thermally stable adhesive, which simultaneously forms a seal against cooked articles running through. The sheet metal insert ring covers the inner circumference of mounting a opening in the mounting plate and has an upper outwardly directed flange engaging over the seal. Simultaneously the seal, in conjunction with the insert ring, centers the hotplate in the mounting opening. A release ring can be inserted for releasing the hotplate.

7 Claims, 6 Drawing Figures

ELECTRIC HOTPLATE WITH A MOUNTING RING AROUND IT

The invention relates to an electric hotplate with a mounting or built-in ring around it and which is fitted into an opening of a mounting or built-in plate.

The problem of the invention is to improve the fitting of a hotplate into a mounting plate and in particular to make it possible to carry out the fitting in sensitive mounting plates, for example ceramic or glass plates.

The problem is solved in that the hotplate is joined to the mounting plate by an adhesive joint.

Whereas hitherto hotplates have always been braced with the mounting plate, according to a preferred feature of the invention the hotplate is so fitted by means of an adhesive joint that it reinforces the hotplate in the particularly endangered area of the mounting opening, instead of additionally stressing the edge of said opening. As a function of the adhesive used, it can simultaneously fulfill the sealing function or the adhesive joint can be formed between an interposed seal and the mounting ring, as well as the mounting plate. In the case that the hotplate is to be readily disengageable again, it would for example be possible to provide a release device, such as an inserted release wire, which can be gripped from the inside. However, in view of the reliability of hotplates, it is rare that individual plates have to be removed and refitted. The cutting open could also take place with an angle cutting device from the inside or outside.

However, it is preferable to use an insert ring covering the inner circumference of the mounting opening, so that it is protected against the radiation from the hotplate, as well as against mechanical damage, whilst providing an additional reinforcement. This insert ring can also be stuck in. Preferably its outer flange engages over the surface of the mounting plate where the adhesive or sealing compound is interposed. It is particularly advantageous if the same adhesive or sealing ring seals the insert ring with respect to the work plate and keeps the mounting ring tight from the inside against the penetration of liquid. In the lower area the insert ring can be somewhat inwardly displaced, so that the sealing or adhesive ring engages around the upper edge of the mounting opening and thus forms a particularly good sealing and flexible impact-protective edge.

The adhesive can be in the form of a liquid or pasty adhesive or an adhesive which is applied in solid form and which must have a relatively good heat resistance. However, the temperatures in the case of a thermally protected hotplate with a preferably very wide, flat mounting ring on the outer circumference thereof are no longer particularly high. Adhesive exist which can easily withstand these temperatures, for example ceramic adhesives based on aluminium, silicon or magnesium oxide, graphite or zirconium, which are able to withstand temperatures of 1000° to 3000° C. There are also single-component cyanoacrylate adhesives, which rapidly harden under the influence of atmospheric humidity and have excellent adhesion and thermal stability characteristics.

It is also possible for the insert ring to be in the form of a double sleeve, which is spaced from the inner wall engaging on the outer circumference of the mounting opening, and which is connected thereto by means of a plurality of connecting webs or the like. It forms an additional heat protection and can simultaneously assist in centering.

The drawings show a number of embodiments of the invention.

FIGS. 3 to 6 show further embodiments.

Figure 1:
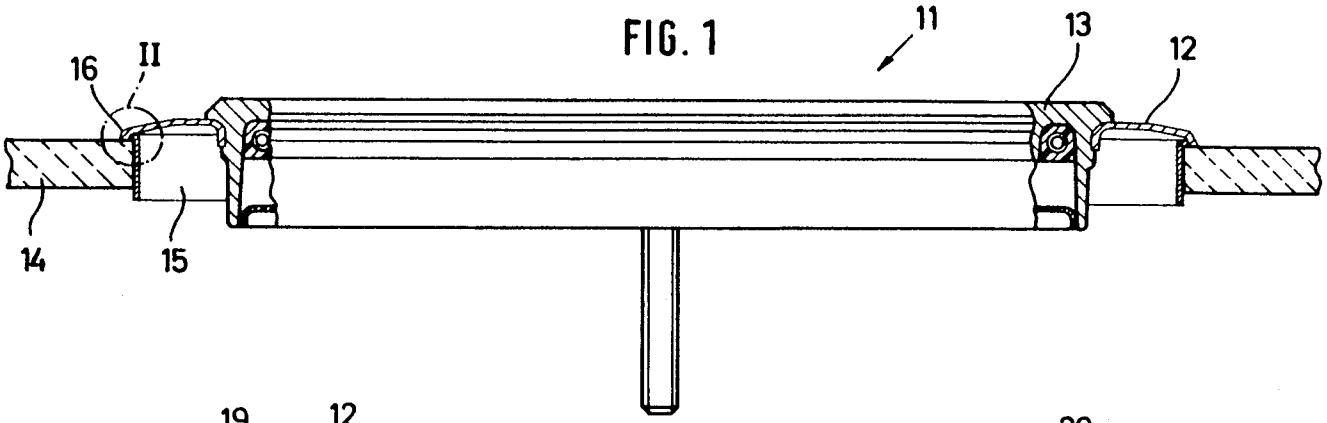
FIG. 1 shows a part sectional side view of an electric hotplate and part of a mounting plate.

FIG. 1 shows a hotplate 11 with a conventional hotplate body made from cast material surrounded by a built-in or mounting ring 12, which is fixed on to the outer circumference of the hotplate body 13 by being pressed on to it. Such an electric hotplate is, for example, described in U.S. Pat. No. 4,153,833, to which reference is made here. It has a shallow inverted U-shaped cross-section with a slightly downwardly sloping outer flank and rests on a mounting plate 14 made from glass, ceramic or optionally other more or less sensitive materials and which has a mounting opening 15, which is significantly larger than the outer circumference of hotplate body 13 and only slightly smaller than the outer circumference of the downwardly directed outer edge 16 of mounting ring 12.

Figure 2:
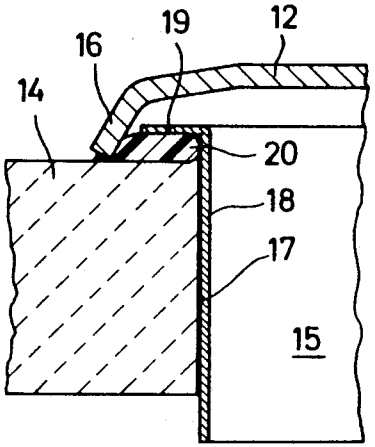
FIG. 2 shows detail II of FIG. 1.

The circumference or wall 17 of plate 14, defining mounting opening 15, is covered by a sheet metal ring 18, which is inserted in the said opening and is self-sealed or stuck therein. It has an upper flange 19 (FIG. 2), which extends up to close to the outer edge 16 of mounting ring 12. Between flange 19 and edge 16 is located a ring 20, which can comprise e.g. a pasty and thermally stable adhesive or a thermally stable sealing ring connected to insert ring 18, mounting ring 12 and workpiece 14 by adhesion and specifically either by self-sealing or by a separately applied adhesive. Ring 20 is guided by insert ring 18 and simultaneously centres mounting ring 12, whilst providing a seal with respect to insert ring and mounting ring.

Figure 3:
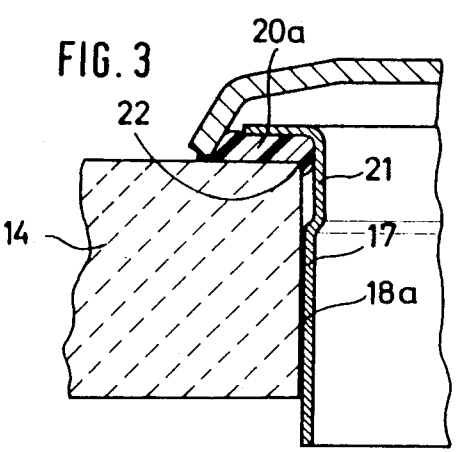
FIG. 3 shows a modified construction of this detail.

FIG. 3 shows a variant where, in the case of an otherwise identical structure, the upper part 21 of insert ring **18*a* is somewhat inwardly displaced, so that ring 20*a* can extend around the upper edge 22** of the workplate, thereby providing a good seal and mechanical protection.

Figure 4:
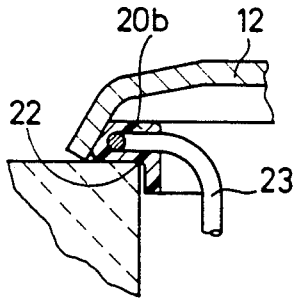

FIG. 4 shows a construction without a metallic insert ring in which a stuck-in sealing ring **20*b* engages round the upper corner 22 of the workplate. A release wire 23** is inserted in the latter and can be gripped and released from the inside, so that in the case of possible disassembly the hotplate can be easily removed.

Figure 5:
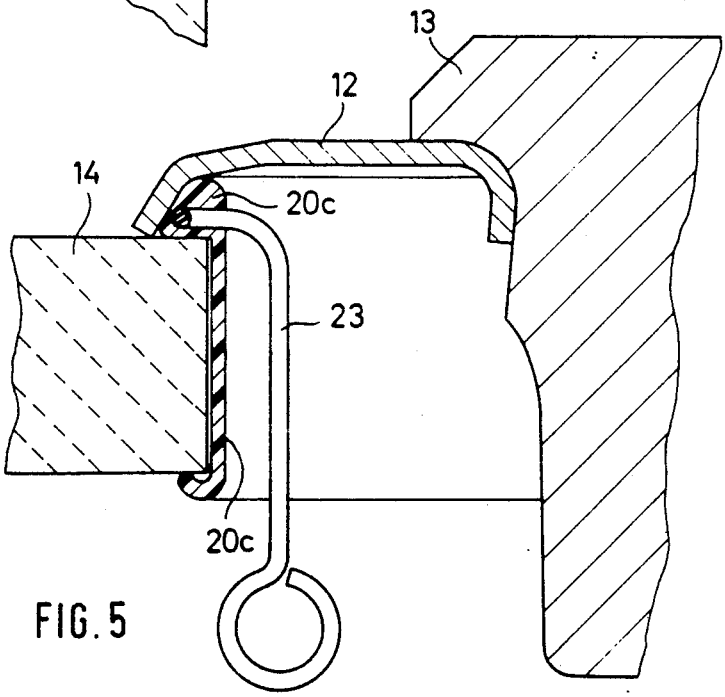

FIG. 5 also shows a construction with a release wire, corresponding to FIG. 4, but in which the sealing ring **20*c*** extends over the entire inner surface of the mounting opening and covers the latter. This construction is particularly suitable in the case of a sealing ring material, which has a high thermal stability and also good insulating characteristics. In this case it will be possible to provide an internal coating of a reflecting material in order to further protect the workplate from thermal influences.

Figure 6:
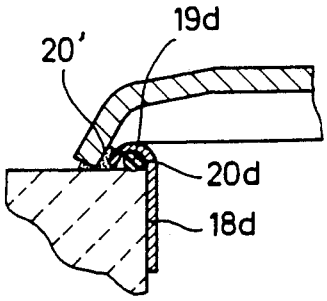

FIG. 6 shows a construction in which a sealing ring **20*d* is placed beneath the semi-toroidally curved flange 19*d* of insert ring 18*d*. In this case the hotplate is directly connected by means of an adhesive joint 20' to the workplate and to the outer surface of flange 19*d***.

A reliable, tightly sealed and particularly shallow hotplate assembly is obtained, which also permits the use of mechanically and thermally sensitive mounting plates.

We claim:

1. A cooking apparatus comprising:

an electric hotplate having a hotplate body of cast material with slots in an underside thereof and heating resistors located in said slots, and a mounting ring surrounding an outer circumference of the hotplate body, the hotplate with the mounting ring being fitted to a mounting opening of a mounting plate, the plate being at least one of glass and ceramic, the hotplate being connected to the mounting plate by a first adhesive joint between the mounting ring and the mounting plate, an insert ring covering a wall of the mounting opening, and the insert ring being connected by a second adhesive joint between the insert ring and at least one of the mounting ring and the mounting plate.

2. The apparatus according to claim 1, further comprising a seal interposed between the mounting plate and mounting ring, the first adhesive joint being between the interposed seal and at least one of the mounting plate and the mounting ring.

3. The apparatus according to claim 2, wherein the mounting ring engages over at least one of the first adhesive joint and seal.

4. The apparatus according to claim 1, wherein the insert ring and the mounting ring are adapted to space and center the hotplate in the mounting opening.

5. The apparatus according to claim 1, wherein the insert ring is spaced from the mounting plate in the vicinity of an upper edge of the mounting plate, and the second adhesive joint extends into the space between the insert ring and the mounting plate.

6. The apparatus according to claim 2, wherein a portion of at least one of the insert ring, seal and the second adhesive joint projects beyond the mounting plate, said portion providing internal guidance and centering of the mounting ring and the hotplate.

7. The apparatus according to claim 2, wherein at least one of the first and second adhesive joints is a thermally stable self-sealing material.

* * * * *